US005246165A

United States Patent [19]

De Matthaeis et al.

[11] Patent Number: 5,246,165

[45] Date of Patent: Sep. 21, 1993

[54] PERFECTED HIGH PRESSURE SEALING SYSTEM FOR THE CONTROL VALVE OF AN ELECTROMAGNETIC INTERNAL COMBUSTION ENGINE FUEL INJECTOR

[75] Inventors: Sisto L. De Matthaeis, Modugno; Mario Ricco, Bari, both of Italy

[73] Assignee: Elasis Sistema Ricerca Fiat Nel Mezzogiorno Societa Consortile per Azioni, Pomigliano D'Arco, Italy

[21] Appl. No.: 783,513

[22] Filed: Oct. 28, 1991

[30] Foreign Application Priority Data

Oct. 31, 1990 [IT] Italy ..... 53353/90[U]

[51] Int. Cl.[5] ..... B05B 47/02; B05B 63/00

[52] U.S. Cl. ..... 239/96; 239/533.8; 239/DIG. 4

[58] Field of Search ..... 239/DIG. 4, 88, 96, 239/533.8, 533.11, 585.1, 585.3; 251/129.18

[56] References Cited

U.S. PATENT DOCUMENTS 4,946,106 8/1990 Turchi et al. ..... 239/96
4,948,049 8/1990 Brisbon et al. ..... 239/96
5,011,082 4/1991 Ausiello et al. ..... 239/585.1

FOREIGN PATENT DOCUMENTS 0304747 3/1989 European Pat. Off. .
2543647 10/1984 France .

*Primary Examiner*—Andres Kashnikow
*Assistant Examiner*—William Grant
*Attorney, Agent, or Firm*—Baker & Daniels

[57] ABSTRACT

The body of a control valve is housed inside the hollow body of an injector by means of a fluidtight connection comprising a pair of precision ground mating surfaces, and a sealing ring compressed between a further two surfaces of the bodies adjacent to the aforementioned pair of surfaces. The ring may be made of rubber, may be fitted between two cylindrical surfaces, and is also pressed by the fuel on to a shoulder of the valve body. Alternatively, the ring may consist of a soft iron washer pressed axially between a flange on the valve body and a surface of the hollow body.

6 Claims, 2 Drawing Sheets

PERFECTED HIGH PRESSURE SEALING SYSTEM FOR THE CONTROL VALVE OF AN ELECTROMAGNETIC INTERNAL COMBUSTION ENGINE FUEL INJECTOR

BACKGROUND OF THE INVENTION

The present invention relates to an electromagnetic injector for internal combustion engine fuel injection systems.

Injectors of the aforementioned type normally comprise a hollow body with a nozzle which is opened for injecting the fuel by a control valve, which connects the control chamber of the nozzle to a drain conduit. The valve comprises a valve body featuring the control chamber, and which is connected to the hollow body by pressurized fuel sealing and connecting means for isolating the control chamber from a drain chamber connected to the drain conduit.

The control valve on known injectors normally comprises a conical surface mating in fluidtight manner with a complementary conical surface on the hollow body. This type of connection is relatively complex and expensive to produce, due to the difficulty of machining and obtaining substantially identical conical surfaces on different parts, as required for ensuring high pressure sealing (e.g. up to 1500 bar).

The use of sealing rings or washers between two parallel surfaces, on the other hand, provides for withstanding only relatively low pressure, e.g. of about 400 bar, which is insufficient for normal fuel injectors.

SUMMARY OF THE INVENTION

It is an object of the present invention to provide an eleotromagnetic injector enabling straightforward fluidtight connection of the control valve and injector body, for overcoming the aforementioned drawbacks.

According to the present invention, there is provided an electromagnetic injector comprising a hollow body with an injection nozzle and a control valve for opening said nozzle, and wherein said valve comprises a valve body having a hole connecting a control chamber to a drain conduit, said valve body being housed in said hollow body via fuidtight connecting means; characterised by the fact that said connecting means comprise a pair of mating surfaces, on said bodies, machined to a high degree of precision for achieving minimum clearance; and a sealing ring compressed between a further two substantially parallel surfaces of said bodies, adjacent to said pair of surfaces.

BRIEF DESCRIPTION OF THE DRAWINGS

Two preferred, non-limiting embodiments of the present invention will be described, by way of example, with reference to the accompanying drawings, in which.

DETAILED DESCRIPTION OF THE INVENTION

Figure 1:
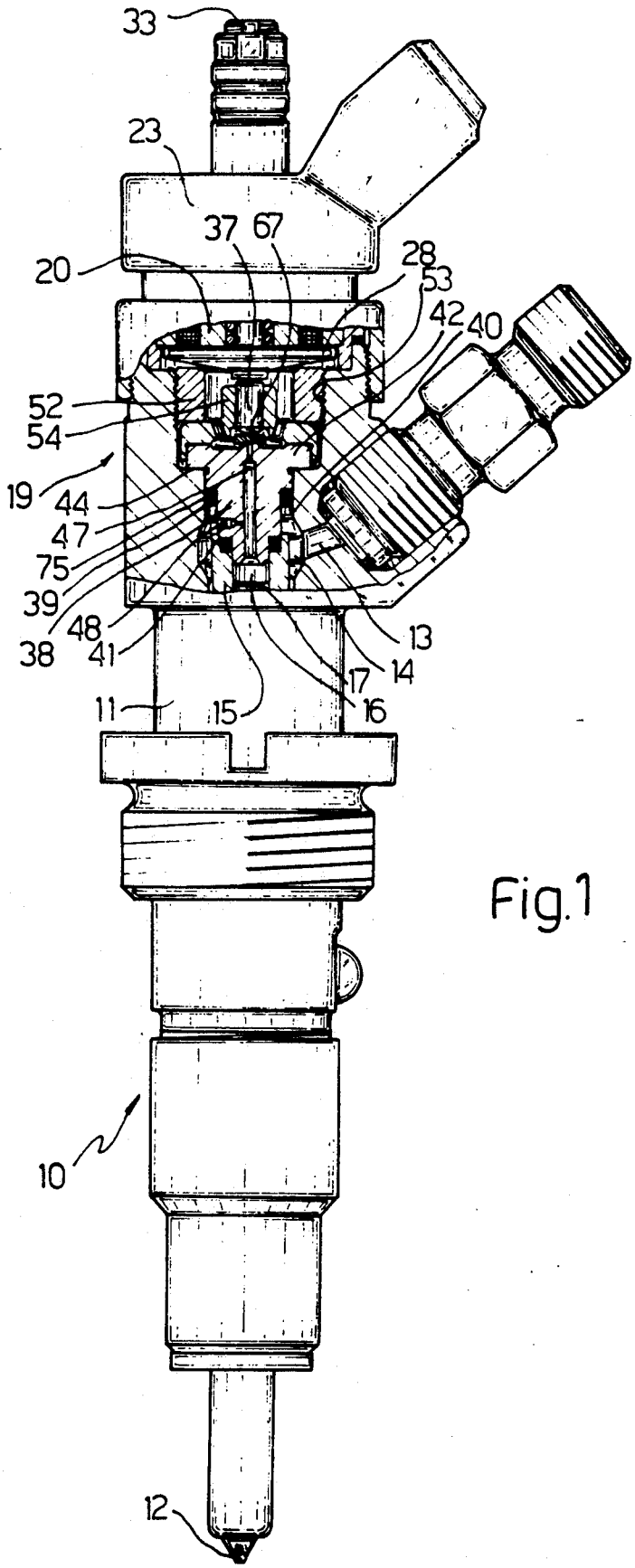
FIG. 1 shows a partially sectioned view of an electromagnetic injector in accordance with the present invention.

Number 10 in FIG. 1 indicates an internal combustion engine fuel injector comprising a tapered hollow body 11 fitted at the bottom with an injection nozzle 12 communicating with a normal high pressure (e.g. 1500 bar) chamber not shown.

The high pressure chamber is supplied in known manner by a pressurized fuel input conduit 13 via an annular chamber 14 and an inner conduit not shown. Conduit 13 is supplied in known manner by a high pressure (e.g. 1500 bar) pump.

Body 11 is fitted inside with a bush 15 having a cylindrical axial cavity 16 housing an axially-sliding, downward-operating rod 17 extending downwards and terminating at the bottom in a tip for plugging nozzle 12.

Rod 17 is controlled by a valve 19 in turn controlled by an electromagnet 20 fitted to body 11 and held in place by a cap 23. Electromagnet 20 controls an anchor 28 having a stem 37 controlling a plate type plunger on control valve 19. Valve 19 comprises a substantially cylindrical body 38 housed in a compartment 39 defined by a cylindrical surface 40 extending upwards of annular chamber 14.

At the bottom, body 38 presents a shoulder 41 sealed inside a seat on the top end of bush 15. At the top, body 38 presents a flange 42 having a flat surface 68 on which plunger 67 rests and at which terminates a calibrated hole 49 connecting a control chamber 47 to a fuel drain conduit 33. Control chamber 47 communicates at the bottom with cavity 16 and, via a radial hole 48, with annular chamber 14, for receiving pressurized fuel from conduit 13.

Flange 42 of body 38 is housed in an enlargement of chamber 39 consisting of a shoulder 44. In particular, flange 42 is integral with a bell-shaped member 51 fitted to hollow body 11 by a threaded ring nut 52 screwed inside a threaded seat 53 on body 11. Member 51 comprises a sleeve 54 forming an annular drain chamber 56 with the inner surface of ring nut 52. The inner surface of sleeve 54 acts as a precision guide for stem 37 of valve 19.

Bell-shaped member 51 also comprises a ring 57 (FIGS. 2 and 3) surrounding flange 42 of body 38, so that member 51 maintains sleeve 54 centered in relation to body 38; and a flange 58 secured to flange 42 by ring nut 52. Between flanges 42 and 58, there is formed an annular chamber 64 communicating with annular chamber 56 via two or more inclined holes 65 through flange 58.

Valve body 38 is connected to hollow body 11 by fluidtight connecting means comprising a pair of mating surfaces, one consisting of surface 70 (FIGS. 2 and 3) of portion 71 of valve body 38, and the other of top portion 72 of surface 40 of compartment 38 on body 11. Surfaces 70 and 72 are precision ground for obtaining a radial clearance of less than 0.05 mm and preferably ranging between 0.02 and 0.03 mm.

Said fluidtight connecting means also comprise a sealing ring of deformable material, compressed between a further two surfaces of bodies 11 and 38, substantially parallel to each other and adjacent to surfaces 70 and 72.

According to a first embodiment of the present invention, body 38 presents a cylindrical surface 73 parallel to cylindrical surface 40 of compartment 30 on body 11. Body 38 also presents a shoulder 74 between surface 70 and surface 73.

Between surfaces 40 and 73 and shoulder 74, there is fitted a ring 75 of elastic material, e.g. rubber, having a substantially round section and generally referred to as an O-ring. Surfaces 40 and 73 are so sized as to leave a gap substantially smaller than the diameter of ring 75, and an annular surface 76 of flange 42 is designed to rest on shoulder 44 of body 11.

Figure 2:
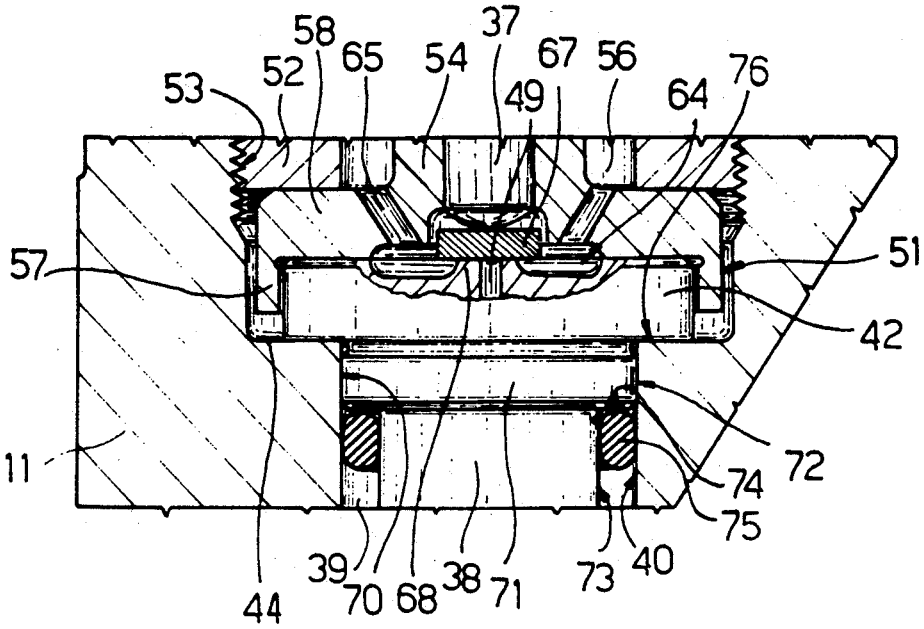
FIG. 2 shows a partial, larger-scale section of a first embodiment of the FIG. 1 injector.

Body 38, complete with member 51 and ring 75, is inserted inside seat 39, and ring nut 52 screwed into threaded seat 53 until surface 76 contacts shoulder 44. Surface 70 thus mates with surface 73, and ring 75 is compressed between surfaces 40 and 73 so as to assume a substantially rectangular section as shown in FIG. 2.

The fuel pressure inside compartment 39 holds ring 75 against shoulder 74, so that it is supported on three sides, thus preventing it from being extruded from its seat, and enabling it to fully withstand far greater pressure (even as high a 1500 bar) than that normally withstood by an O-ring.

Figure 3:
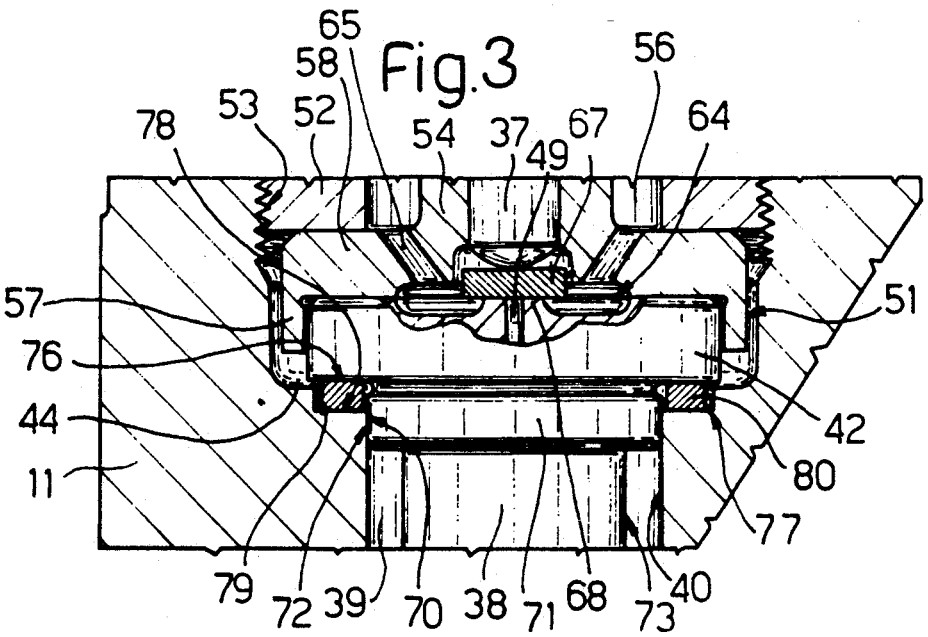
FIG. 3 shows a further embodiment of the FIG. 2 section.

In the FIG. 3 embodiment, shoulder 44 of body 11 presents a recess 77 having a flat surface 78 and a cylindrical surface 79, and designed to house a washer 80 of deformable material such as soft iron. Washer 80 presents a rectangular section, is higher than surface 79 of recess 77, and is compressed by annular surface 76 of flange 42.

In this case, after inserting washer 80 inside recess 77, body 38 together with member 51 is inserted inside compartment 39; ring nut 52 is torqued so as to press flange 42 on to washer 80; and washer 80 is compressed and distorted to a certain extent between surface 76 of flange 42 and surface 78 of recess 77, for ensuring effective sealing.

When compressed, as described above, washer 80 still remains slightly higher than surface 79 of recess 77, and, being enclosed by two walls of body 11 and two walls of body 38, is safeguarded against extrusion due to overtorquing, and fully capable of withstanding the aforementioned fuel pressure.

The advantages of the injector according to the present invention will be clear from the foregoing description. Firstly, precision grinding mating cylindrical surfaces 70 and 72, and machining cylindrical surfaces 40 and 73 in FIG. 2 and flat surfaces 76 and 78 in FIG. 3, are far cheaper than the conical surface machining required by known injectors. Secondly, the combination of seal 75, 80 and mating surfaces 70, 73 provides for withstanding far greater pressures than those normally accommodated by such seals.

To those skilled in the art it will be clear that changes may be made to the injector as described and illustrated herein without, however, departing from the scope of the present invention. For example, the fluidtight connection may feature both ring 75 and metal washer 80.

We claim:

1. An electromagnetic internal combustion engine fuel injector comprising a hollow body (11) with an injection nozzle (12) and a control valve (19) for opening said nozzle (12), and wherein said valve (19) comprises a valve body (38) having a hole (49) connecting a control chamber (47) to a drain conduit (33), said valve body (38) being housed in said hollow body (11) via fluidtight connecting means comprising a pair of mating surfaces (70, 72), on said bodies (38, 11), machined to a high degree of precision for achieving minimum clearance, each said mating surface (70, 72) being cylindrical, and said clearance being less than 0.05 mm; and a sealing ring (75, 80) compressed between a further two substantially parallel surfaces (73, 40; 76, 78) of said bodies (38, 11), adjacent to said pair of surfaces (70, 72).

2. An injector as claimed in claim 1 wherein said valve body (38) is fitted in said hollow body (11) by means of a threaded ring nut (52) screwed inside a seat (53) on said hollow body (11); a bell-shaped member (51) between said ring nut (52) and said valve body (38) being designed to press on a flange (42) on said valve body (38) in a direction parallel to the axis of said cylindrical surface (70, 72).

3. An injector as claimed in claim 2, wherein said bell-shaped member (51) presses said flange (42) against a shoulder (44) of said hollow body (11).

4. An injector as claimed in claim 1, wherein said further two surfaces (73, 40) are also cylindrical, and that said ring (75) is formed of elastic material; one of said bodies (38, 11) comprising a shoulder (74) for supporting said ring (75) perpendicular to said further two surfaces (73, 40).

5. An injector as claimed in claim 4, wherein said shoulder (74) is supported on said valve body (38); said ring (75) presenting substantially round section; and said further two surfaces (73, 40) being spaced so as to deform said ring (75) and produce a substantially rectangular section.

6. An injector as claimed in claim 1, wherein said further two surfaces (76, 78) are flat and annular; said ring consisting of a washer (80) of deformable metal material, fitted between a flange (42) on said valve body (38) and a recess (77) in a shoulder (44) of said hollow body.

* * * * *